United States Patent [19]

Becklund

[11] 4,056,061

[45] Nov. 1, 1977

[54] PROXIMITY FUSE

[75] Inventor: Orville A. Becklund, Dallas, Tex.

[73] Assignee: Texas Instruments Incorporated, Dallas, Tex.

[21] Appl. No.: 788,019

[22] Filed: Jan. 20, 1959

[51] Int. Cl.[2] ..... F42C 13/02

[52] U.S. Cl. ..... 102/70.2 P

[58] Field of Search ..... 102/70.2, 3; 250/83.3 IR, DIG. 44, 88.3 DR, 203, 214, 232, 233; 114/21.1; 244/14.3; 315/83.1

[56] References Cited

U.S. PATENT DOCUMENTS

| | | | |
|---|---|---|---|
| 2,441,030 | 5/1948 | Page | 102/70.2 P |
| 2,489,223 | 11/1949 | Herbold | 250/339 |
| 2,730,654 | 1/1956 | Rabinow | 315/83 |
| 2,794,926 | 6/1957 | Watts et al. | 250/345 |
| 2,878,396 | 3/1959 | Behm et al. | 250/233 |
| 2,925,965 | 2/1960 | Pierce | 102/70.2 P |
| 2,932,743 | 4/1960 | Atwood | 250/352 |

*Primary Examiner*—Charles T. Jordan
*Attorney, Agent, or Firm*—Harold Levine; Rene' E. Grossman; Alva H. Bandy

EXEMPLARY CLAIM

1. An infrared proximity fuse comprising means to transduce infrared radiation intensity into the amplitude of an electrical signal, first circuit means including a low pass filter connected to filter substantially all frequencies except DC from said electrical signal, thus generating a DC output signal, second circuit means including a high pass filter connected to filter substantially all low frequencies from said electrical signal, thus generating an AC output signal, a demodulator having as its input said AC output signal from said second circuit means to produce a DC signal corresponding to the amplitude of said AC output signal, a gate circuit means having as inputs said DC output signal from said first circuit means and said DC signal corresponding to the amplitude of said AC output signal, said gate circuit means having means to generate an output signal solely during an interval when said DC output signal is above a maximum preset level and said DC signal corresponding to the amplitude of said AC output signal is below a minimum preset level, a detonator, and means responsive to production of the output signal of said gate circuit means to energize said detonator.

3 Claims, 1 Drawing Figure

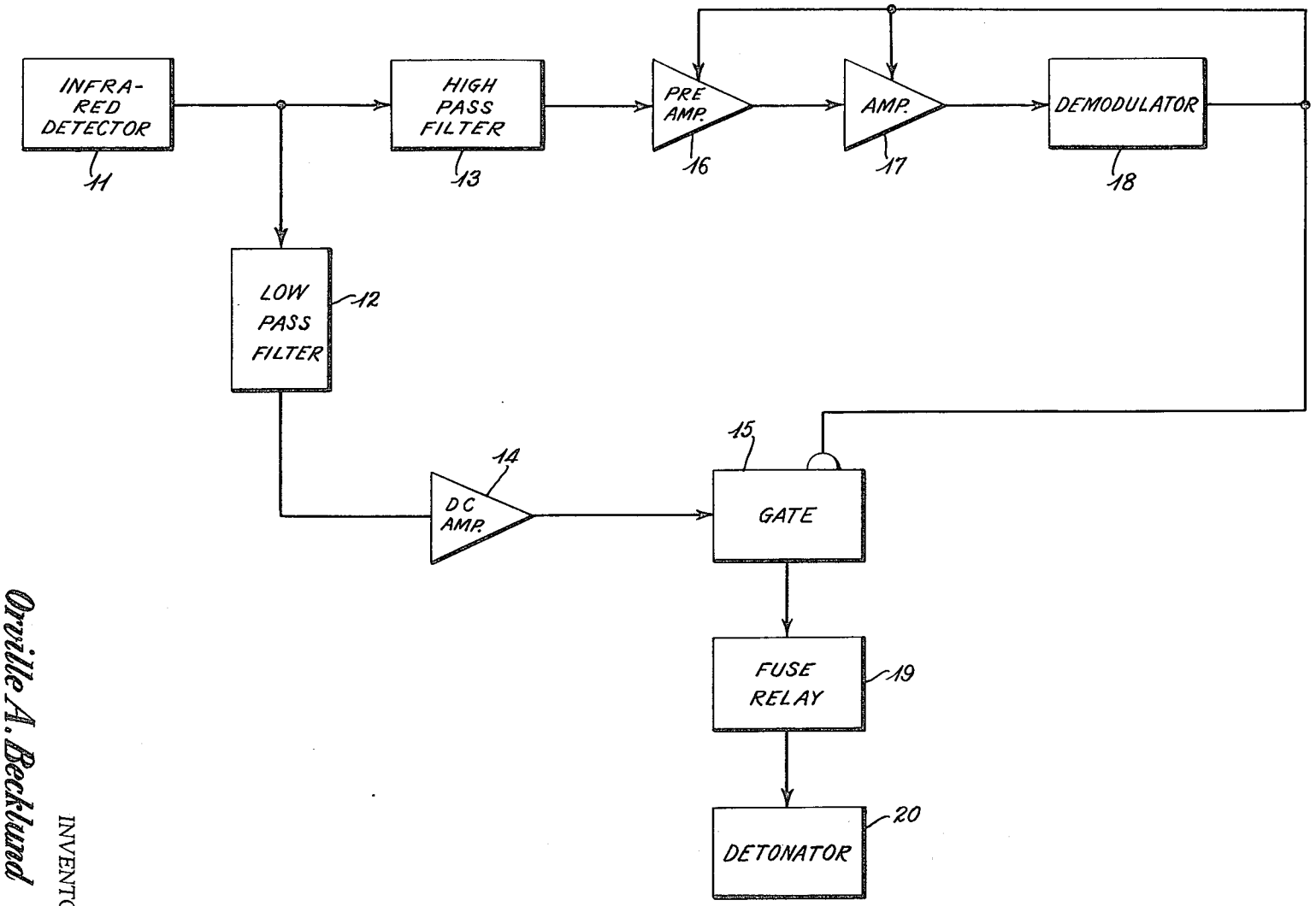
INVENTOR
*Orville A. Becklund*
BY *Stevens, Davis, Miller & Mosher*
ATTORNEYS

PROXIMITY FUSE

This invention relates to an infrared proximity fuse for use in ground-to-air and air-to-air missiles.

Prior to the present invention proximity fuses were generally known. However, there has been a real need to provide a proximity fuse with a higher kill probability, as the proximity fuses of the prior art have a high probability of being actuated at the wrong time. If a proximity fuse is made sensitive enough that it will detonate the missile when the missile gets in the correct proximity of the target, then it is very likely that the fuse will detonate the missile before it gets into the correct proximity of the target. If the sensitivity of the proximity fuse is reduced to prevent this premature detonation, then the probability increases that the missile will pass by the target without detonating at all.

Therefore it is one object of the present invention to provide a proximity fuse which is less likely than the proximity fuses of the prior art to detonate the missile prematurely, and yet has a greater probability of detonating than the proximity fuses of the prior art when the missile does come into the correct proximity with the target, thus greatly increasing its kill probabilty.

The proximity fuse of the present invention utilizes infrared radiation from the target. The basic principle upon which it operates is that the following conditions should exist when the missile is in the correct proximity with the target: (a) The radiation portion of the target looms large; (b) The total radiation power being collected is high; and (c) The radiation from the target area at close range is uniform from point to point.

Thus the missile war head should be detonated only when these conditions prevail. To detect these conditions an infrared cell is used. The signal produced by this cell will have a high DC level when these conditions prevail because of the large target image and the high total power of intercepted radiation. On the other hand, the AC level of the detected signal will be very low because the image field is uniform, and therefore, as the target moves across the viewing field of the detector, no net change in transduced radiation occurs. The fuse of the present invention provides circuitry which will detect when this combination of conditions exists in the signal.

Further objects and advantages of this invention will become readily apparent as the following detailed description of the preferred embodiment unfolds and when taken in conjuction with the sole FIGURE which shows a block diagram functionally illustrating the apparatus of the invention.

As shown in the FIGURE, the proximity fuse of the present invention comprises infrared detector 11. This detector 11 comprises an infrared cell which detects impinging radiation from a viewing field of a predetermined size and transduces this detected radiation into an electrical signal with the magnitude of the signal being proportional to the intensity of the detected radiation. The output electrical signal from the infrared detector 11 is applied to a low pass filter 12 and to a high pass filter 13. The low pass filter 12 filters out practically all frequencies except DC from the electrical signal. The filtered DC output signal from the filter 12 is amplified by DC amplifier 14 and applied to gate 15. The high pass filter 13 eliminates all low frequency components from the output signal of the infrared detector 11 so that only AC components remain in the output signal of the high pass filter 13. A preamplifier 16 and amplifier 17 amplify the output signal from the high pass filter 13. The output signal from the amplifier 17 is applied to a demodulator 18 which produces a DC output signal having an amplitude corresponding to the amplitude of the AC signal applied thereto. The DC output signal from the demodulator 18 is fed back to the preamplifier 16 and the amplifier 17 to provide an automatic gain control for these amplifiers. The DC output signal from the demodulator 18 is also applied to the gate 15 as an inhibit signal. The gate 15 comprises a circuit which will produce an output signal only if the signal applied thereto from the DC amplifier 14 is above a predetermined level and the DC output signal of the demodulator 18 applied thereto is below a predetermined level. When both of these conditions exist, the gate 15 will apply an output signal to the fuse relay 19 and in response to receiving this signal, the fuse relay 19 will be energized and actuate the detonator 20. The detonator will then explode the missile. Thus, the missile will be exploded only if the output signal from the DC amplifier 14 is above a predetermined level and the output signal from the demodulator 18 is below a predetermined level. Both of these conditions will occur only when the signal transduced by the detector 11 has a high DC component and a low AC component. Thus the missile will be detonated only when the radiating portion of the target looms large and a high radiation power is being detected, thus giving rise to the high DC component in the transduced signal and only when the radiation power from the target is uniform from point to point causing little change in the intensity of the detected radiation as the target moves across the viewing field of the detector 11 thus giving rise to the low AC component in the detected signal.

In the actual circuit for the proximity fuse, the high pass filter 13 is combined with the preamplifier 16 simply by using an ordinary AC preamplifier which will, of course, only amplify AC signals. Similarly, the low pass filter 12 is combined with DC amplifier 14 by using a DC amplifier having AC suppression. The automatic gain control embodied in the feed back of the output signal from the demodulator 18 to the preamplifier 16 and the amplifier 17 prevents the DC signal applied to the gate 15 from becoming so large as to have an adverse effect on the operation of the relay 19.

All of the circuits mentioned above as suitable for use in the present invention are conventional and well known types and detailed description of the circuits and their mode of operation is therefore believed unnecessary.

The above description is of a preferred embodiment of the invention and many modifications and changes can be made thereto without departing from the spirit and scope of the invention which is limited only as defined in the appended claims.

What is claimed is:

1. An infrared proximity fuse comprising means to transduce infrared radiation intensity into the amplitude of an electrical signal, first circuit means including a low pass filter connected to a filter substantially all frequencies except DC from said electrical signal, thus generating a DC output signal, second circuit means including a high pass filter connected to filter substantially all low frequencies from said electrical signal, thus generating an AC output signal, a demodulator having as its input said AC output signal from said second circuit means to produce a DC signal corresponding to the amplitude of said AC output signal, a gate circuit means having as inputs said DC output signal from said first circuit means and said DC signal corresponding to the amplitude of said AC output signal, said gate circuit means having means to generate an output signal solely during an interval when said DC output signal is above a maximum preset level and said DC signal corresponding to the amplitude of said AC output signal is below a minimum preset level, a detonator, and means responsive to production of the output signal of said gate circuit means to energize said detonator.

2. The apparatus of claim 1 wherein said first circuit means includes a DC amplifier and said second circuit means includes an AC amplifier.

3. An infrared proximity fuse comprising a detonator, means to actuate said detonator, gate means for applying an output signal to said means to actuate said detonator, an infrared transducer to detect infrared energy and convert said energy to corresponding electrical signals, a pair of parallel paths electrically interconnecting said transducer and said gate means, one of said parallel paths including a low pass filter and the other of said parallel paths including a high pass filter and a demodulator, said gate means producing an output signal in response to the signal in one of said parallel paths being above a minimum preset level and the signal in the other of said parallel paths being below a maximum preset level whereby said means to actuate said detonator, in response to an output signal from said gate means, actuates said detonator.

* * * * *